US008448651B2

(12) United States Patent
Honnefeller et al.

(10) Patent No.: US 8,448,651 B2
(45) Date of Patent: May 28, 2013

(54) HAIR CARE DEVICE

(75) Inventors: Katja Honnefeller, Friedrichsdorf (DE); Christine Bachmann, Frankfurt am Main (DE); Gisa Nicolin, Wiesbaden (DE); Juergen Seng, Kelkheim (DE); Michael Kloeppel-Riech, Friedberg (DE); Phong Vu, Schwalbach (DE)

(73) Assignee: Braun GmbH, Kronberg (DE)

( * ) Notice: Subject to any disclaimer, the term of this patent is extended or adjusted under 35 U.S.C. 154(b) by 0 days.

(21) Appl. No.: 12/669,915

(22) PCT Filed: Jul. 22, 2008

(86) PCT No.: PCT/EP2008/005978

§ 371 (c)(1),
(2), (4) Date: Aug. 10, 2010

(87) PCT Pub. No.: WO2009/015802

PCT Pub. Date: Feb. 5, 2009

(65) Prior Publication Data

US 2011/0005539 A1 Jan. 13, 2011

(30) Foreign Application Priority Data

Jul. 27, 2007 (DE) ..... 10 2007 035 245

(51) Int. Cl.
*A45D 20/08* (2006.01)
*A45D 24/22* (2006.01)
*A45D 24/10* (2006.01)

(52) U.S. Cl.
USPC ..... 132/271; 132/112; 132/118

(58) Field of Classification Search
USPC ..... 132/115, 118, 120, 126, 148, 157, 132/219, 221, 271, 272, 112; 15/160, 169, 15/184, 246, 1.51, 1.52; 81/490, 439; 7/167; 359/511; 361/221, 112
See application file for complete search history.

(56) References Cited

U.S. PATENT DOCUMENTS 3,213,860 A * 10/1965 Tewksbury et al. ..... 132/238
3,218,653 A * 11/1965 Colone ..... 7/167
4,019,192 A * 4/1977 Miyagawa ..... 396/349

(Continued)

FOREIGN PATENT DOCUMENTS

DE 3614633 A1 11/1987
DE 8714036 U1 11/1988

(Continued)

OTHER PUBLICATIONS

International search report dated Oct. 27, 2008 containing 2 pages.

*Primary Examiner* — Robyn Doan
*Assistant Examiner* — Tatiana Nobrega
(74) *Attorney, Agent, or Firm* — Jeffrey V Bamber; Kim W Zerby

(57) ABSTRACT

The present invention relates to a hair care device (1) with a handle (3), a function head (4) having a hair treatment means, preferably comprising a bristle and/or a tooth field and/or air blower outlet means, as well as with an ion discharging device (8) for releasing ions, which has at least one ion outlet (9) and can be actuated by an actuating switch (10). According to the invention, the hair care device is characterized in that a closure device (11) for closing the ion outlet is provided, which can be actuated by the actuating switch.

12 Claims, 6 Drawing Sheets

U.S. PATENT DOCUMENTS

Figure 1:
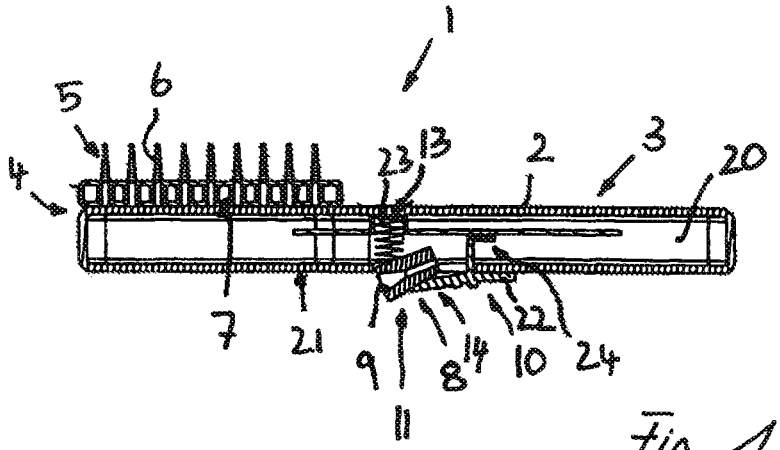

| | | | | |
|---|---|---|---|---|
| 4,904,847 | A * | 2/1990 | Kosaka et al. | 392/384 |
| 5,150,491 | A * | 9/1992 | Ikemoto | 15/1.52 |
| 5,212,510 | A * | 5/1993 | Baxter | 396/349 |
| 6,334,718 | B1 * | 1/2002 | Akiba et al. | 396/448 |
| 6,907,888 | B2 * | 6/2005 | Saida et al. | 132/271 |
| 7,156,839 | B2 * | 1/2007 | Bayer et al. | 606/1 |
| 7,287,532 | B2 * | 10/2007 | Hafemann | 132/232 |
| 7,568,848 | B2 * | 8/2009 | Ho | 396/448 |
| 7,800,682 | B2 * | 9/2010 | Nagamine et al. | 348/335 |
| 7,914,157 | B2 * | 3/2011 | Zhou et al. | 353/119 |
| 2002/0062836 | A1 * | 5/2002 | Saida et al. | 132/271 |
| 2002/0100488 | A1 * | 8/2002 | Taylor et al. | 132/271 |
| 2004/0020070 | A1 | 2/2004 | Ito | |
| 2004/0118425 | A1 | 6/2004 | Santhouse et al. | |
| 2004/0129288 | A1 * | 7/2004 | Saida et al. | 132/228 |
| 2005/0016559 | A1 * | 1/2005 | Saida et al. | 132/271 |
| 2005/0172979 | A1 * | 8/2005 | Saida et al. | 132/228 |
| 2005/0194016 | A1 | 9/2005 | Yeh | |
| 2005/0284495 | A1 * | 12/2005 | Yasuda et al. | 132/272 |
| 2006/0254396 | A1 * | 11/2006 | Hu | 81/177.4 |
| 2008/0019000 | A1 * | 1/2008 | Lee | 359/511 |
| 2008/0053982 | A1 * | 3/2008 | Ceva | 219/225 |
| 2008/0186584 | A1 * | 8/2008 | Ballard | 359/611 |
| 2009/0034074 | A1 * | 2/2009 | Kobayashi | 359/511 |
| 2009/0241975 | A1 * | 10/2009 | Nakakura | 132/120 |
| 2010/0263223 | A1 * | 10/2010 | Wynne | 34/97 |
| 2010/0269849 | A1 * | 10/2010 | Ishikawa et al. | 132/271 |
| 2011/0007395 | A1 * | 1/2011 | Kao et al. | 359/511 |
| 2011/0043913 | A1 * | 2/2011 | Wang | 359/511 |
| 2011/0058255 | A1 * | 3/2011 | Weiss | 359/511 |
| 2011/0088275 | A1 | 4/2011 | Kloeppel-Riech et al. | |
| 2011/0088714 | A1 | 4/2011 | Kloeppel-Riech et al. | |
| 2011/0094535 | A1 | 4/2011 | Kloeppel-Riech et al. | |
| 2011/0315158 | A1 | 12/2011 | Kloeppel-Riech et al. | |

FOREIGN PATENT DOCUMENTS

| | | | |
|---|---|---|---|
| DE | 9420602 | U1 | 2/1995 |
| EP | 0492092 | A1 | 7/1992 |
| JP | 61-220611 | A | 9/1986 |
| JP | 6-38803 | U | 5/1994 |
| JP | 2004-166932 | A | 6/2004 |
| JP | 2004/344354 | | 12/2004 |

* cited by examiner

HAIR CARE DEVICE

The present invention relates to a hair care device with a handle, a function head having hair treatment means, preferably comprising a bristle and/or a tooth field and/or air blower outlet means, as well as with an ion discharging device for releasing ions, which has at least one ion outlet and can be actuated by an actuating switch.

Recently, there have been hair care devices such as hair dryers and hair brushes have been known, which, in addition to their primary function, release ions as an auxiliary application, i.e. releasing an air stream for the purposes of drying the hair or combing, brushing, and shaping the hair. Such types of ions are typically molecules charged with negative electrons. With the aid of such an ion application, the hair and the hair care can be improved, particularly the static charging of the hairs and a corresponding sticking out of the hairs can be prevented; in addition, an improved wetting capacity can be achieved.

From US 2005/284495, a hair brush or a hair dryer with an integrated brush attachment is known having an ion outlet which releases ions in the direction of the function head, both on the back side of the device facing away from the bristle field, and on the front side of the device which bears the bristle field. However, said known hair care device could be improved with respect to the handling of the ion discharging device; in particular, the ion emitter is at risk of damage and soiling due to its projecting arrangement.

Furthermore, US 2005/194016 discloses a foldable hair brush, in the form similar to a mobile telephone, whose folding leg bears a bristle field and whose other folding leg has an ion discharging device. The ion outlet in this case is in the area of the folding hinge on the front, which is arranged on the aforementioned second folding leg, so that the ions are directed toward the bristle field when the device is unfolded and that the ions exit in the front from the hinge area when the device is folded. The ion function can be switched on and switched off via a laterally arranged sliding switch. This known hair care device is also disadvantageous with respect to its handling. On one hand, the aforementioned sliding switch is difficult to operate while, on the other hand, the ion discharging device in this case is also at risk of damage and soiling Starting from this point, the object of the present invention is to create an improved hair care device of the type mentioned, which will avoid the disadvantages of the prior art and further developed upon the latter in an advantageous manner. In particular, the handling of the hair care device should be simplified, the ion discharging device should be protected from damage, and soiling of the device should be avoided.

Said object is achieved according to the invention by means of a hair care device according to Claim 1. Preferred embodiments of the invention are the subject matter of the dependent claims.

Thus, it is proposed that the ion discharging device be protected from external effects when the ion discharging device is not in operation. When the ion function is not required, the ion outlet can be covered in order to protect the ion discharging device from external effects, mechanical damage, and soiling. According to the invention, the hair care device is characterized by a closure device for closing the ion outlet. In order to achieve particularly easy handling, a particular provision is that the closure device can be opened or closed by the aforementioned actuating switch for actuating the ion discharging device. The aforementioned actuating switch in this case can function simultaneously as an on/off switch or a power level switch, i.e. it may have or actuate an electric switching means which switches the ion discharging device on and off or changes its power level. The actuating switch hereby has a dual function to the extent that it mechanically protects the ion discharging device, on one hand, and actuates from a technical control perspective, on the other. This simplifies handling of the hair care device significantly, because the closure device can be automatically actuated, so to speak, when the ion discharging device is switched on or switched off. In addition, there is the advantage that the ion discharging device is not just protected for the purposes of transport but that the hair care device can also be used without the ion function.

The closure device may be configured in essentially different ways. According to one advantageous embodiment of the invention, the closure device may have a closure element, which is attached in a moving manner, and which can be moved onto or over the ion outlet such that the closure element covers the ion outlet in its closure position. In this case, the closure element may be attached in a sliding manner, in the form of a slide, to a device housing. Alternatively, the closure element may also be designed in the form of a flap, which is attached to swivel on the housing, and which can be swiveled via the ion outlet when the latter is not being used.

The closure element is advantageously coupled to the actuating switch in a manner such that actuation of the closure element simultaneously actuates the actuating switch and vice versa. In particular, the actuating switch can simultaneously form the closure element, wherein the actuating switch can be designed, for example, in the form of a sliding switch, which can be pushed over the ion outlet or which comprises a sliding part that can be slid over the ion outlet.

Alternative or in addition, a provision, in an especially advantageous manner, can be that the ion outlet is attached in a moving manner such that it can be retracted into a device housing and/or can be placed behind a housing contour.

Various designs are possible with respect to the moving attachment of the ion outlet. Advantageously, the ion outlet can be designed as a swiveling flap, which can be swiveled, in an advantageous manner, into a device housing and/or device body contour in order to cover the ion outlet and which, on the other hand, can be swiveled outward in order to bring the ion outlet into its exposed operating position. The closure device in this case can be formed solely by the moving ion outlet and the corresponding device contour. Alternatively, the closure device can additionally have a closure element of the aforementioned type, which can be moved over the ion outlet, particularly in its retracted position. Advantageously, a coupling can be provided between the closure element and the movability of the ion outlet, particularly designed such that the movement of the closure element moves the ion outlet thereby placing the latter into its retracted position. For example, when the ion outlet is designed as a swiveling flap, the latter can have a back forming a ramp, upon which the closure element designed as a slide can be slid, so that the ion outlet retracts into the device body.

In an advantageous further embodiment of the invention, the ion outlet can also be designed in the form of a retractable and extendable pushbutton, wherein, in the position in which it is retracted into the device body, the ion outlet or its opening is retracted in the device body, whereas, in an extended position of the pushbutton, the ion outlet or its opening is exposed.

When the closure device is designed with an ion outlet attached in a moving manner, the aforementioned ion outlet can be coupled to the actuating switch and/or formed by the actuating switch, so that the closure movement of the ion outlet between its retracted, covered position behind the device contour and its extended, exposed position can simultaneously be used as an actuating movement for the actuating switch. For example, when the ion outlet is designed in the form of a retractable and extendable pushbutton, the actuating switch can be designed as a pushbutton switch.

To facilitate operation of the closure device, pretension means, which pretension the closure device into its open position, can be allocated to the closure device in a further embodiment of the invention. In order to still be able to hold the closure device in its closed position, detachable holding means are advantageously provided, which can counteract the pretension of the pretension means. The holding means in this case may be designed in different ways. For example, they may be formed in the aforementioned manner by the closure element, which is movable over the retractable and extendable ion outlet, which, in turn, is tensioned by the aforementioned pretension means, for example is tensioned in its open position in the form of a spring. Alternatively or in addition, holding means in the manner of a so-called touch-latch fitting, as is known with drawers, and/or in the form of a rotary/latching mechanism, as is known with ballpoint pens, can be provided, which can be locked and then released in the same direction in an alternating manner, i.e. upon the first push that exceeds a latch point, the latching engages upon the backward movement, whereas the next excessive push releases the latch and there is no stopping the backward movement. This principle is particularly well known with ballpoint pens, with which a one-time push extends the point and the point can be retracted by another push.

In a further embodiment of the invention, the actuating switch can also be utilized for actuating auxiliary functions of the hair care device; in particular, it can have an auxiliary function switching means for actuating a light or other functions of the device.

To enable an ion exit that is not covered by hair or the user's hand, the ion outlet, in a further embodiment of the invention, can be arranged on a device back side facing away from the hair treatment means, particularly the bristle field. Advantageously, the ion outlet is aligned symmetrically with respect to the longitudinal center plane of the hair care device and/or directed toward the function head of the hair care device, such that an ion cloud results over the back side of the function head. The ion outlet in this case may be aligned essentially parallel with respect to the back side surface, so that the ions escape essentially parallel to the back side of the device, via the device back side. Alternatively or in addition, an ion discharge that is deflected in a slightly steep-angled manner can be provided. The ion outlet can be tilted at an angle of from 0° to 45° with respect to the surface of the back side.

In order to still be able to facilitate simple operation and actuating of the device, the actuating switch may be arranged on a device side opposite the ion outlet, according to an advantageous embodiment of the invention. If the ion outlet is arranged on the device back side in the aforementioned manner, the actuating switch may be arranged on the device front side, on which the hair treatment means of the function head, particularly its bristle field, is also arranged. In this manner, the actuating switch can be ergonomically operated, particularly with a thumb, which is typically lying on the device front side. To this end, the actuating switch can advantageously lie in the area of the device body, on which the thumb of a user's hand comes to rest with a typical grip.

The actuating switch in this case can have more than two positions, particularly with the aforementioned coupling with the closure device. In particular, a provision can be that, in a first position of the actuating switch, the closure device is closed and the ion discharging device is switched off, whereas, in a second position of actuating switch, the closure device is open and the discharging device is still switched off, whereas, in turn, in a third position of the actuating switch, the closure device is open and the ion discharging device is activated. In this manner, the ion discharging device can, for example, be briefly switched off without having to close the ion outlet. Advantageously, the three positions of the actuating switch may be selected by means of a movement of the actuating switch in the same or the opposite direction, for example configured such that when the actuating switch is designed as a sliding switch, the three positions lie along one line and the aforementioned second position lies between the first and third positions, wherein the latter may also form the end positions of the switch at the same time.

The actuating switch does not, however, have to be designed as a sliding switch. In a further embodiment of the invention, the actuating switch may also comprise a flip switch that is attached to the housing in a manner so as to flip. According to another advantageous embodiment of the invention, the actuating switch may also comprise a retractable and extendable pressure switch attached to the housing.

In a further embodiment of the invention, the actuating switch may also have multiple actuating elements, each of which are movable, to which various functions are assigned. In particular, the arrangement of the actuating elements can be of a manner such that a first actuating element is attached to a second actuating element, in a moving manner, such that the two actuating elements can move together due to operation of the second actuating element and that the first actuating element can additionally be moved relative to the second actuating element. In particular, two pressure switches, which are located within one another, can be provided, of which one is designed in the shape of a ring to accommodate the other.

Advantageously, one of the actuating elements may be connected to the electric or electronic control means for switching on/off or for changing the switching level of the ion discharging device, while the other actuating element is connected to the closure device for closing the ion outlet.

In an especially advantageous embodiment of the invention, the closure device may have cleaning agents for cleaning the ion discharging device. These cleaning agents can essentially have various designs and configurations. Advantageously, a cleaning element that is retractable in the ion outlet can be provided, which can be designed particularly as a brush, sponge, or textile ball. In this manner, soiling that gets into the ion outlet not just during operation or when the closure device is open can also be removed. Simultaneously, the cleaning element also forms additional protection for the sensitive tip of the ion emitter.

Advantageously, the cleaning agents may be attached to the closure element, which is attached in a moving manner, of the closure device, so that the aforementioned cleaning element is automatically moved into the ion outlet when the closure element moves on or over the ion outlet. If an attachment of the ion outlet is carried out so as to move in the aforementioned manner, the cleaning element may also be configured to be fixed or moving on the device housing or the device body, so that the cleaning element can retract into the ion outlet when the ion outlet retracts into its closed position.

In order to facilitate the handling of the device as a whole, a modular device construction with multiple device modules, which can be separated from one another, is provided in a further embodiment of the invention. Advantageously, the function head in this case is allocated to a different device module than the ion discharging device. In particular, the function head can be removed or replaced from the further device body, so that various function heads can be attached to the device, so that, for example, various handling functions are executable or so that different users can use their own function heads. The ion discharging device in this case is advantageously provided at the main body of the device, so that each exchangeable function head does not have to have its own ion discharging means. In addition, the separation of the function head and the ion discharging device is advantageous because the function head can be more easily cleaned or even washed. Advantageously, the function head is configured so as to be free of electric fixtures.

In order to be able to remove and/or replace the function head in a simple manner, tool-free removable connecting means, which may be held in place with friction and/or positive engagement, are advantageous. For example, sliding and/or latching brackets and pockets may be provided, with the assistance of which the function head can be solidly attached to the device body, but still easy to remove.

Figure 2:
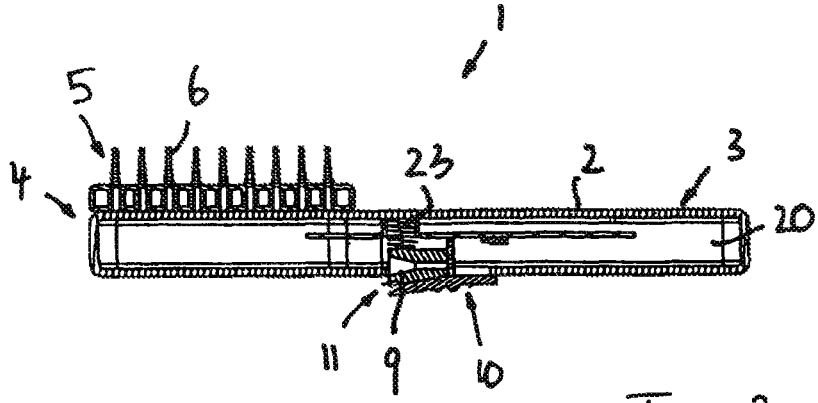
Figure 3:
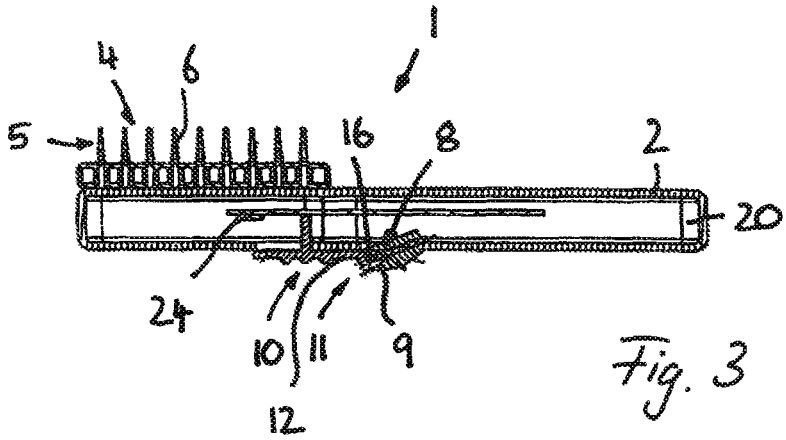
Figure 4:
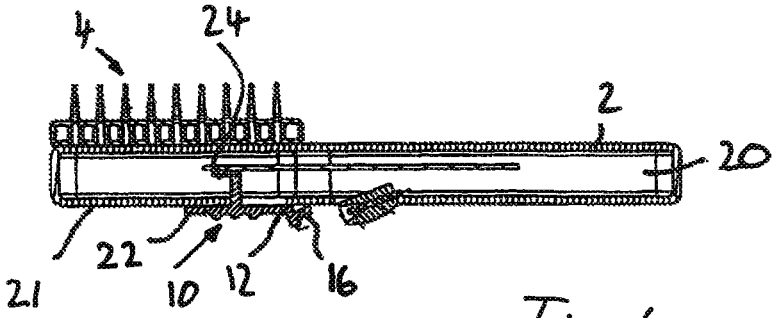
Figure 5:
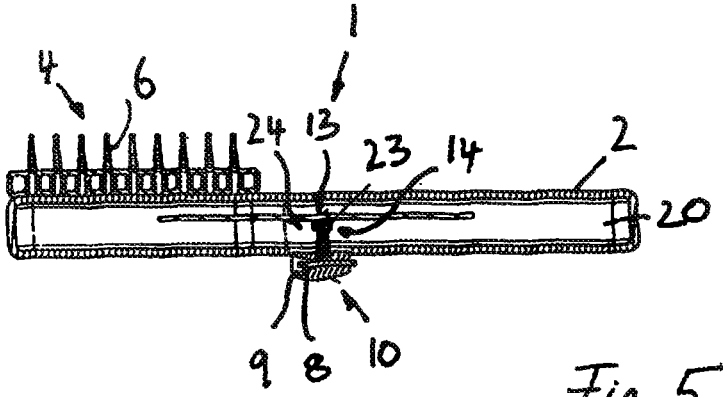
Figure 6:
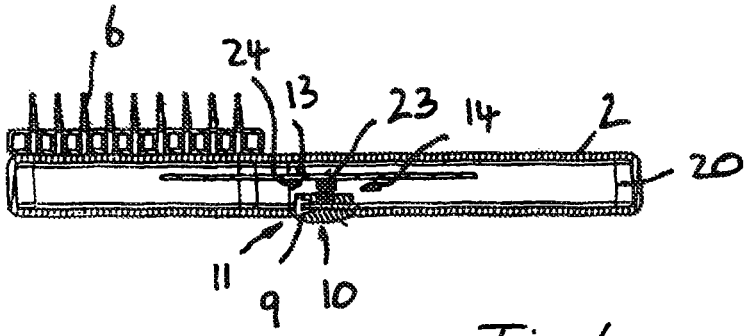
Figure 7:
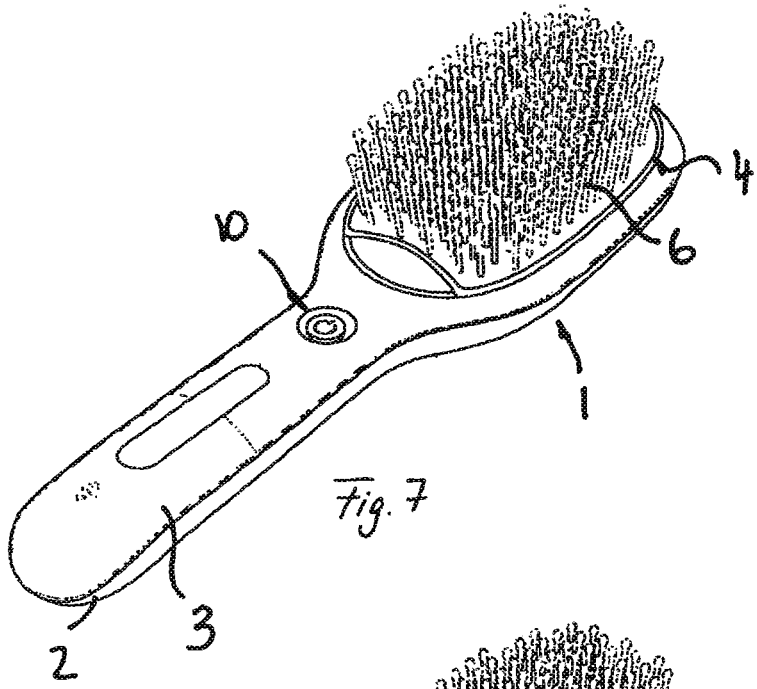
Figure 8:
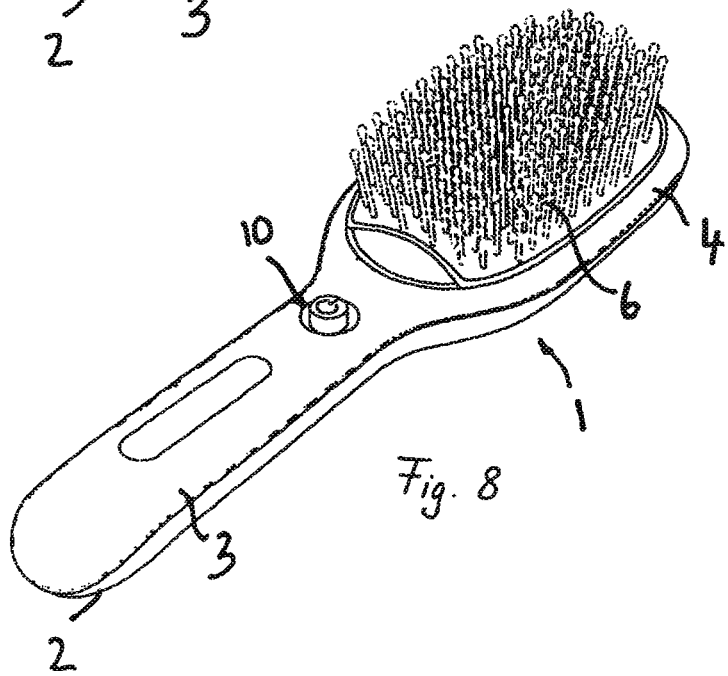
Figure 9:
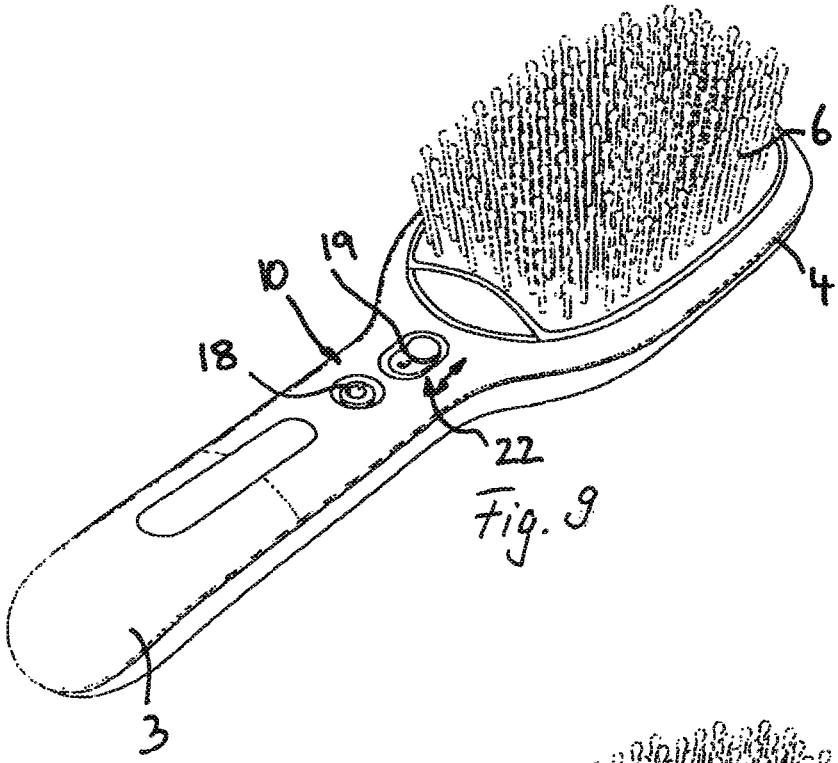
Figure 10:
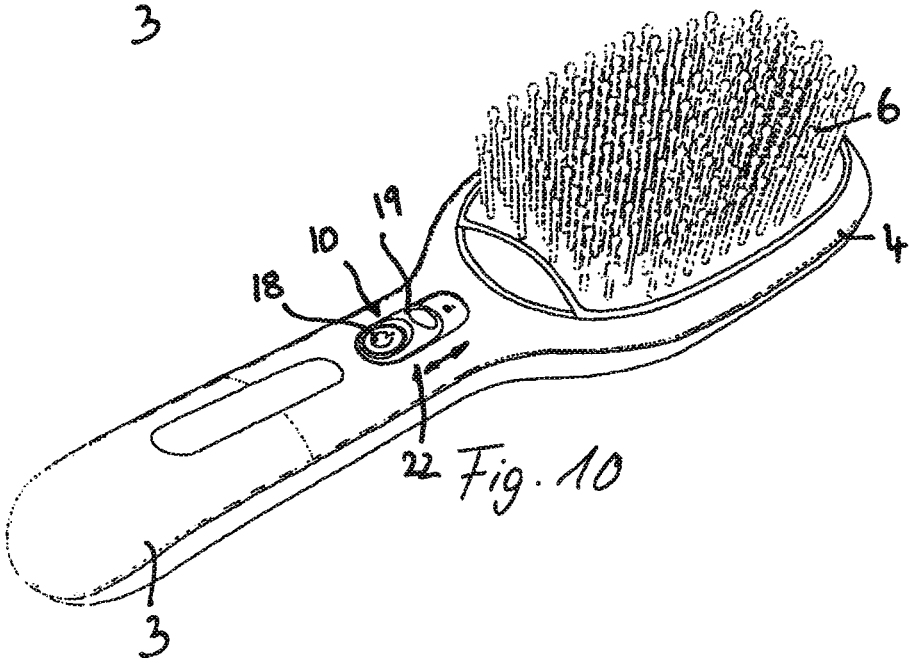
Figure 11:
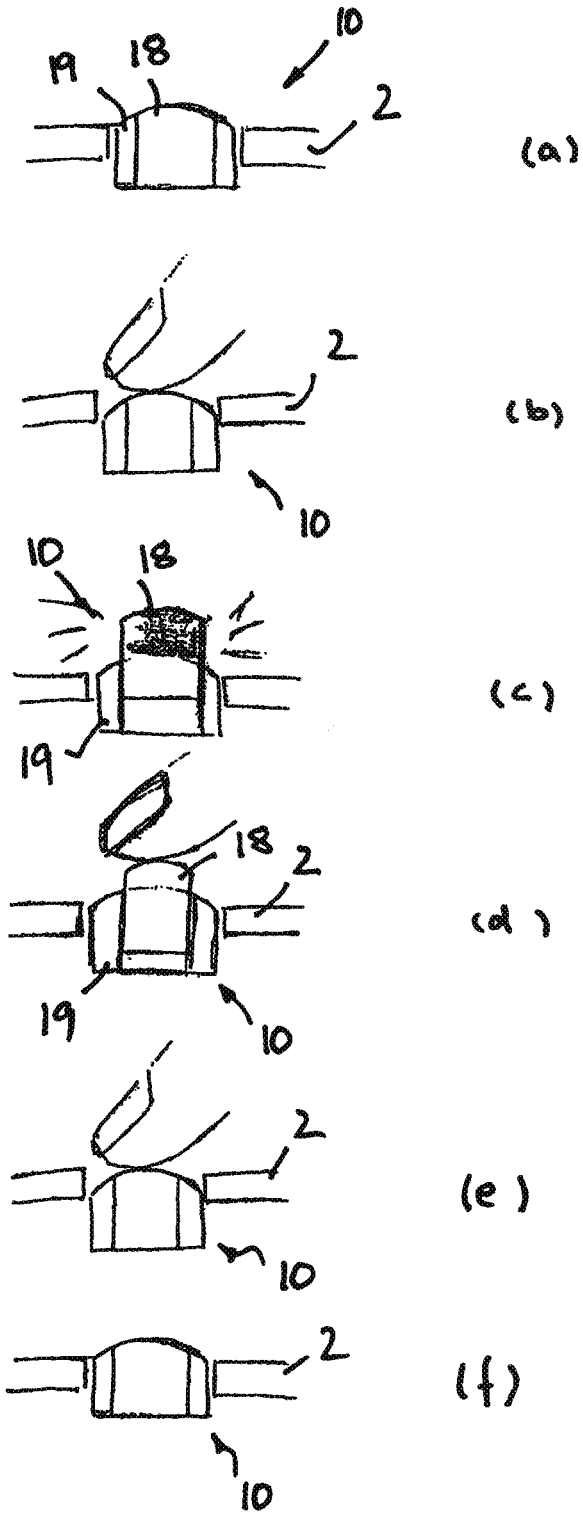

These and other features are based on the claims as well as on the following description and can form the subject matter or a preferred embodiment of the present invention alone or in sub-combination, regardless of their summary in the claims. The invention is illustrated in more detail in the following by means of preferred exemplary embodiments and corresponding drawings. The drawings show the following:

FIG. 1 shows a schematic longitudinal cross-section of a hair brush with an ion discharging device according to an advantageous embodiment of the invention, in which an ion outlet is provided in the form of a swiveling flap, FIG. 2 shows a longitudinal cross-section of the hair brush of FIG. 1, which shows the ion outlet in the retracted, closed position, FIG. 3 shows a schematic longitudinal cross-section of a hair brush according to another advantageous embodiment of the invention, in which a movable closure element may be slid with a cleaning tip into the ion outlet, FIG. 4 shows a longitudinal cross-section of the hair brush of FIG. 3, which shows the closure element in the pushed-away, closed position, FIG. 5 shows a schematic longitudinal cross-section of a hair brush according to another advantageous embodiment of the invention, in which the ion outlet is designed in the form of a pushbutton-like retractable and extendable element, FIG. 6 shows a longitudinal cross-section of the hair brush of FIG. 5, which shows the ion outlet in its retracted, closed position, FIG. 7 shows a schematic, perspective illustration of a hair brush according to another advantageous embodiment of the invention, in which the actuating switch for actuating the ion discharging device and for closing the closure device for the ion outlet is arranged on a device front side opposite the ion outlet, FIG. 8 shows a perspective illustrating of the hair brush from FIG. 7, which shows the actuating switch in its extended position, FIG. 9 shows a schematic, perspective illustration of a hair brush according to another advantageous embodiment of the invention, in which the actuating switch for actuating the ion discharging device and the closure device for the ion outlet have separate actuating elements for actuating the ion function and for closing the ion outlet, FIG. 10 shows a schematic, perspective illustration of a hair brush according to another advantageous embodiment of the invention, in which the actuating switch comprises a sliding element and a pressure element as actuating elements and the pressure element is arranged on the sliding element, and FIG. 11 shows a schematic sectional view of the actuating switch of a hair brush according to another advantageous embodiment of the invention, wherein the actuating switch has two pressure elements located within one another and is shown in various switch positions.

The hair care device 1 shown in FIGS. 1 and 2 is designed as a hair brush and comprises a device main body 20, which is designed as a handle and which has electronic fixtures in its interior, which are yet to be described. The aforementioned handle 3 bears a function head 4, which bears a bristle field 6 as hair treatment means 5. However, it is understood that other hair treatments means 5 such as, for example, heating rods and hair shaping elements or even a blower outlet may be provided, if the hair care device is designed as a hair shaping device and/or hair dryer. The aforementioned hair treatment means may also optionally be combined with one another, for example to the extent that air discharge slots are provided in the bristle field 6.

Advantageously, the hair care device 1 has a modular construction with multiple modules that can be placed on one another. In particular, the function head 4 is configured separately from the device main body 20, wherein preferably positive-engagement-functioning connecting means, for example in the form of latching brackets and pockets, which enable tool-free removal and reattachment of the function head 4, are provided between the two modules.

Furthermore, an ion discharging device 8 provided on the device main body 20 forming the handle 3, which comprises an ion emitter designed in a known manner, which is located in the interior space of the device main body 20 and is connected to an ion outlet 9, which is arranged in the area of the housing 2 of the device main body 20, cf. FIG. 1. In the embodiment shown, the ion outlet 9 is designed in the form of a nozzle or diffuser and effects a directed release of ions. In the embodiment shown, the ion outlet 9 is advantageously arranged on the device back side 21, which is facing away from the bristle field 6 and forms the back of the hair brush so to speak. The ion outlet 9 in this case is essentially arranged in and parallel to the longitudinal center plane of the hair care device 1 and directed toward the function head 4 or its back side, so that a cloud of ions lying over the function head 4 can be discharged. In the embodiment shown, the ion outlet 9 is tilted with its primary exit direction at an angle of about 25° with respect to the longitudinal axis of the handle 3, cf. FIG. 1.

The aforementioned ion outlet 9 in the embodiment shown in FIGS. 1 and 2 is designed as a flap, which is attached to swivel on the housing 2, the flap having an outlet channel to release the ions. As a comparison of FIGS. 1 and 2 shows, the ion outlet 9 designed as a flap can rotate around a swiveling axis that is aligned essentially parallel to the housing surface such that the ion outlet 9 can be retracted in the housing 2 by swiveling or, vice versa, can be swiveled out of the housing 2. In the retracted position, the opening of the ion outlet 9 is, so to speak, hidden in the interior of the housing 2, whereas, in the extended position, the opening of the ion outlet 2 is arranged outside of the housing 2, cf. FIGS. 1 and 2.

In the embodiment shown, an actuating switch 10, in the form of a sliding element or slide 22, is provided for actuating the retractable ion outlet 9; the actuating switch 10 is arranged on the housing surface and can be moved along said surface. The aforementioned slide 22 in this case can be slid over the ion outlet 9, so that said outlet is pressed into the housing 2 by swiveling. The back of the ion outlet 9 and an access section of the slide 22 form a wedge-shaped or diagonal-shaped surface pair, which converts the sliding movement of the slide 22 parallel to the housing surface into a swivel movement of the ion outlet 9, which is essentially vertical with respect to the aforementioned housing surface.

As FIGS. 1 and 2 show, pretension means 13, in the form of a spring element 23, are allocated to the ion outlet 9, and the spring element 23 pretensions the ion outlet 9 in its extended position. The slide 22 on the other hand forms a holding means 14, which can hold the ion outlet 9 in the retracted position, counter to the spring pretension, when the slide 22 is in the position shown in FIG. 2.

The retractable design of the ion outlet 9 together with the housing contour, into which the ion outlet 9 can be swiveled, form the closure device 11 mentioned at the beginning of the document, with the assistance of which the ion outlet 9 is closeable.

Advantageously, the actuating switch 10 comprises electric and/or electronic control and/or switching means 24, in addition to the sliding element and/or slide 22, with the help of which the power of the ion discharging device 8 is controlled, in particular with which the ion discharging device 8 can be switched on and off. The aforementioned switching means 24 are advantageously coupled to the slide 22, so that the ion discharging device 8 can be activated or deactivated at the same time the ion outlet 9 is closed or opened.

FIGS. 3 and 4 show an embodiment of a hair brush essentially similar to that in FIGS. 1 and 2, in which corresponding components are provided with the same reference numbers, wherein reference in this regard is made to the prior description. As FIGS. 3 and 4 show, the closure device 11 with this embodiment is formed by a closure element 12, which can be moved onto the ion outlet 9. The closure element 12 in this case is provided at a section of the actuating switch 10, which, in turn, is designed as a slide 22. Contrary to the previous embodiment, the retraction of the ion outlet 9 into the housing 2 is not provided. Instead, the closure element 12 is bluntly moved onto the ion outlet 9 in order to cover it.

Advantageously, a cleaning agent for cleaning the ion outlet 9 and for cleaning the ion discharging device 8 is provided on the closure element 12. The cleaning agent in this case comprises a cleaning element 16 designed as a soft body, which moves into the aforementioned ion outlet 9 when the closure element 12 moves onto the ion outlet 9. The tip of the cleaning element 16 in this case can advantageously be moved onto the tip of the ion discharging device 8, in order to clean the latter as well. If the closure element 12 is moved away from the ion outlet 9, the cleaning element 16 also moves out of the ion outlet 9 and carries away any soiling found therein, cf. FIG. 4. Advantageously, with this embodiment as well, the actuating switch 10, by means of which the closure device 11 is actuated, is also simultaneously provided for activating or deactivating the ion discharging device 8. The slide 22 actuates a corresponding electric switching means 24 when it reaches the position that opens the closure device 11, cf. FIG. 4.

As FIGS. 5 and 6 show, the ion outlet 9 can also be configured in the form of a piston- or pushbutton-like switching element, which can be retracted linearly into the housing 2 and extended from it in the opposite direction. In the extended position, which FIG. 5 shows, the ion outlet 9 is exposed, whereas the ion outlet 9 or its opening in the retracted position, which FIG. 6 shows, is hidden in the interior of the housing 2. Advantageously, a pretension device, in the form of a spring element, is then allocated to the switching element forming the ion outlet 9, and the pretension device pretensions the ion outlet 9 in its open position. In order to hold the ion outlet 9 in the retracted position, counter to the spring pretension, holding means 14, preferably in the form of a rotary/latching device, as is known with ballpoint pens, are allocated. The ion outlet 9 can, accordingly, be released by pressing at a force to exceed that holding the retracted latching position, so that it can extend from the housing while being subjected to the spring pretension. The ion outlet 9 latches back into its closed position when the pressure is accordingly reapplied.

The ion outlet 9 or the pushbutton-like switching element having the ion outlet 9 advantageously and simultaneously forms the actuating switch 10, by means of which the ion discharging device 8 can be activated or deactivated and/or by means of which its power level can be controlled. To this end, corresponding switching means 24 in the interior of the device housing 2 can be actuated by the actuating switch 10.

As FIGS. 7 and 8 show, the actuating switch 10 can also advantageously be arranged on the device side opposite the ion outlet 9. If the ion outlet 9 is arranged on the device back side, as previously described, the actuating switch 10 is then arranged on the device front side, on which the bristle field 6 of the hair brush is also arranged, cf. FIGS. 7 and 8. In doing so, the actuating switch 10, together with the ion outlet 9, can be designed, so to speak, to pass through the device housing 2, so that the ion outlet 9 extends when pressure is applied to the actuating switch 10 on the opposite side and vice versa. As an alternative to this, the actuating switch 10 with the ion outlet 9 can also be coupled via a corresponding gearing connection such that the ion outlet 9 located on the opposite side also retracts when pressure is applied to the actuating switch 10. Alternatively, the actuating switch 10 can also be coupled to a closure element 12, which is attached in a movable manner, on the opposite side, which can be moved onto the ion outlet 9, in a manner similar to the embodiment according to FIGS. 3 and 4, in order to close the ion outlet 9. In the previously described manner, the actuating switch 10 with the embodiment according to FIGS. 7 and 8 may also have further switching means and/or cause actuation in order to switch the ion discharging device 8 on and off and/or to control its power and/or other auxiliary functions such as switching a light on and off. Advantageously, a provision can also be that the actuating switch 10 controls different functions by means of actuating paths of different lengths, in particular such that the closure device 11 is actuated by a complete retraction or extension, while a short actuation of the actuating switch 10 from the position that opens the closure device 11 suffices for actuating the aforementioned further switching means, in particular for switching the light on and off and/or for reactivating the ion discharging device 8, for example after it has been switched off by a time switch after a preset time.

As FIG. 9 shows, the actuating switch 10 may also have two separate actuating elements 18 and 19, which can realize the same or different actuation principles. In the embodiment shown, one control element 18 is designed as a pressure switch, while the other control element 19 is designed as a slide. Advantageously, the slide can be provided for actuating the closure device 11, while the pressure switch can serve to control the aforementioned additional switching means, particularly for activation of the ion discharging device 8 or further auxiliary functions.

As FIG. 10 shows, both actuating elements 18 and 19 can also be integrated inside one another or connected to one another to form a single unit. In the embodiment shown in FIG. 10, actuating element 18, which is designed as a pressure switch, is attached to actuating element 19, which is designed as a slide, so that the two actuating elements 18 and 19 can be moved together, whereby the closure device 11 is advantageously actuated. In addition, the first actuating element 18, which is designed as a pressure switch, can also be actuated relative to the other actuating element 19, preferably in order to actuate the aforementioned further switching means.

An alternative embodiment of such an actuating switch 10 having two actuating elements 18 and 19 is shown in FIG. 11. Here, both actuating elements 18 and 19 are designed as a pressure switch. As FIG. 11 shows, the two actuating elements 18 and 19 are integrated inside one another. One actuating element is in the shape of a ring and accommodates the other actuating element within it. If the actuating switch 10 is pressed as a whole from the position shown in FIG. 11*a*, as is shown in FIG. 11*b*, the closure device 11, on one hand, is opened, and the ion discharging device 8, on the other hand, is activated. The latter can occur by means of the inner actuating element jumping outward, cf. FIG. 11*c*. If the ion function stops by means of a time switch after a preset time has elapsed, the ion function can be reactivated by briefly touching the interior of the two actuating elements. A button connected with this reactivates the ion function. If, on the other hand, the ion discharging device 8 is supposed to be completely switched off and the closure device 11 reclosed, both actuating elements 18 and 19 are fully pressed, cf. FIG. 11*e*, so that the starting position is once again achieved, cf. FIG. 11*f*.

What is claimed is:

1. A hair care device comprising a handle, said handle comprising a housing, said handle being joined to a function head, said function head comprising a hair treatment means, said hair care device further comprising an ion discharging device for releasing ions, an actuating switch, and a closure device, all located on said hair care device, wherein said ion discharging device has at least one ion outlet, and can be actuated by said actuating switch, and said closure device comprises a closure element is provided for closing the ion outlet, and can be actuated by the actuating switch.

2. The hair care device of claim 1, wherein the closure element is connected to the actuating switch and/or comprises part of the actuating switch, a pretension means for pretensioning the closure device in an open position as well as a holding means for holding the closure device in a closed position are joined to the closure device wherein the holding means is formed by the closure element, which is attached in a moving manner and can be moved over the ion outlet.

3. The hair care device of claim 1, wherein the closure device provides movable attachment of the ion outlet, and the ion outlet is retractable in the device housing.

4. The hair care device of claim 3, wherein the ion outlet is arranged in the form of a swiveling flap.

5. The hair care device of claim 3, wherein the ion outlet, which is attached in a movable manner, is connected to the actuating switch and/or comprises part of the actuating switch and/or is integrated in the actuating switch.

6. The hair care device of claim 1, wherein the holding means can be detached by applying excess pressure to the closure element and/or the ion outlet beyond the closed position.

7. The hair care device of claim 1, wherein the closure device further comprises a cleaning agent for cleaning the ion discharging device.

8. The hair care device of claim 1, wherein the actuating switch comprises an auxiliary function switching means for actuating auxiliary device functions.

9. The hair care device of claim 8, wherein: in a first position of the actuating switch, the closure device is closed and the ion discharging device is switched off; in a second position of the actuating switch, the closure device is open and the ion discharging device is switched off; and, in a third position of the actuating switch, the closure device is open and the ion discharging device is switched on.

10. The hair care device of claim 9, wherein a first actuating element of the actuating switch is attached to a second actuating element of the actuating switch, in a moving manner, such that both actuating elements can move together due to movement of the second actuating element and the first actuating element can additionally be moved relative to the second actuating element.

11. The hair care device of claim 1, wherein a modular device construction is provided with multiple device modules, which are separable from one another, wherein the function head and the ion discharging device are arranged on separate device modules.

12. The hair care device of claim 11, wherein the device module having the function head is designed so as to be free of electric fixtures.

* * * * *